US010451996B2

(12) United States Patent
Katsuya et al.

(10) Patent No.: US 10,451,996 B2
(45) Date of Patent: Oct. 22, 2019

(54) DEVELOPING BLADE, DEVELOPING DEVICE, AND CARTRIDGE

(71) Applicant: CANON KABUSHIKI KAISHA, Tokyo (JP)

(72) Inventors: Shohei Katsuya, Kawasaki (JP); Yoshiyuki Batori, Hiratsuka (JP); Hiroshi Takarada, Kawasaki (JP); Koji Wada, Yokohama (JP); Goshi Ozaki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/039,086

(22) Filed: Jul. 18, 2018

(65) Prior Publication Data

US 2019/0025729 A1 Jan. 24, 2019

(30) Foreign Application Priority Data

Jul. 21, 2017 (JP) ..... 2017-142025

(51) Int. Cl.
*G03G 15/08* (2006.01)

(52) U.S. Cl.
CPC ..... *G03G 15/0812* (2013.01); *G03G 15/0808* (2013.01); *G03G 15/0817* (2013.01); *G03G 15/0898* (2013.01); *G03G 15/0818* (2013.01); *G03G 2215/0634* (2013.01)

(58) Field of Classification Search
CPC ..... G03G 15/0812; G03G 15/0808; G03G 15/0818; G03G 15/0817; G03G 15/0898
See application file for complete search history.

(56) References Cited

U.S. PATENT DOCUMENTS

| | | | | |
|---|---|---|---|---|
| 5,701,558 | A * | 12/1997 | Kojima | G03G 15/0817 399/103 |
| 2011/0236057 | A1* | 9/2011 | Nakajima | G03G 15/0817 399/103 |
| 2013/0129378 | A1* | 5/2013 | Hoshi | G03G 15/0812 399/106 |
| 2017/0068211 | A1* | 3/2017 | Watanabe | G03G 21/1817 |

FOREIGN PATENT DOCUMENTS

| | | | |
|---|---|---|---|
| JP | 2016-12105 | A | 1/2016 |
| JP | 2016-66077 | A | 4/2016 |
| JP | 2016-142749 | A | 8/2016 |
| JP | 2017-54007 | A | 3/2017 |

* cited by examiner

*Primary Examiner* — Carla J Therrien
(74) *Attorney, Agent, or Firm* — Canon USA, Inc., IP Division

(57) ABSTRACT

A developing device includes a developer bearing member, a developer container, a regulating blade including a plate-like elastic portion, and an elastic seal sealing, and a pressing member pressing the elastic seal, wherein the plate-like elastic portion includes a metal plate, a second projection projecting from a second surface of the metal plate facing the developer bearing member, and a first projection projecting from a first surface opposite to the second surface of the metal plate, and wherein a projecting amount of the first projection is greater than a projecting amount of the second projection, wherein a top surface of the second projection contacts the surface of the developer bearing member, and an end surface of the first projection contacts an end surface of the elastic seal in the rotation axis direction.

15 Claims, 9 Drawing Sheets

DEVELOPING BLADE, DEVELOPING DEVICE, AND CARTRIDGE

BACKGROUND OF THE INVENTION

Field of the Invention

The present disclosure relates to a developing blade, a developing device, and a cartridge used in an image forming apparatus.

A cartridge described here includes at least one of developer, a developing roller, and a process unit and is detachably attachable to an image forming apparatus main body (hereinbelow, an apparatus main body). An image forming apparatus forms an image on a recording medium using an electrophotographic image forming process. An example of an image forming apparatus includes an electrophotographic copying machine, an electrophotographic printer (a light-emitting diode (LED) printer, a laser beam printer, etc.), a facsimile machine, and a word processor.

Description of the Related Art

An apparatus main body forms an electrostatic image by irradiating a photosensitive drum (an image bearing member) with light corresponding to image data. The apparatus main body supplies developer (hereinbelow, toner) to the electrostatic image from a developing roller (a developer bearing member) of a developing device and develops the electrostatic image as a toner image. The toner image is transferred from the photosensitive drum to a recording material such as recording paper by a transfer device. The toner image is fixed to the recording material by a fixing device, and thus a recorded image is formed. A developing device using toner uses a developing blade for regulating a layer thickness of the toner on the developing roller. In addition, a configuration is discussed for sealing toner by providing a sealing member between the developing roller and a developer container to prevent toner leakage from an end portion of the developing roller.

For example, Japanese Patent Application Laid-Open No. 2016-66077 describes a developing device which includes a developing roller, a developing blade, sealing members which are disposed on both end portions of the developing roller in an axis direction for sealing between the developing roller and a developer container, and a seal pressing member for pressing a side surface of the sealing member. In the developing device, the seal pressing member applies pressing force to the side surface of the sealing member in a direction toward a center of the developing device and deforms the sealing member to attach a side surface opposite to the pressed side of the sealing member to the developing blade.

Accordingly, the sealing members abut on the developing roller on the both end portions of the developing blade in the axis direction of the developing roller to prevent outflow of toner and toner leakage between the developing blade and the sealing member at the same time.

A metal blade of stainless steel and the like may be used as a developing blade in some cases. In this case, a blade thickness is generally 1 mm or less. Thus, it is discussed that the configuration in which the seal pressing member presses the side surface of the sealing member to attach the side surface of the sealing member opposite to the pressed portion to the developing blade as described in Japanese Patent Application Laid-Open No. 2016-66077 is applied to a developing blade using metal. However, when a thin metal blade is used, it was found that the sealing member disposed on a longitudinal end portion was deformed and crawled under the developing blade, and the sealing member was brought into contact with a back surface opposed in a thickness direction to a front surface abutting on the developing roller. The sealing member is brought into contact with the developing blade and urges the developing blade toward the developing roller, and thus an abutting pressure is increased between the developing blade and the developing roller, and a failure of toner circulation is caused. Accordingly, there is a possibility that the toner melts and adheres to the developing blade and causes an image defect.

SUMMARY OF THE INVENTION

According to an aspect of the present invention, a developing device includes a developer bearing member configured to bear developer on a surface thereof, a developer container configured to contain the developer and rotatably support the developer bearing member, wherein the developer is supplied from the developer container to the developer bearing member, a regulating blade including a plate-like elastic portion, configured to regulate a thickness of a layer of the developer born on a surface of the developer bearing member, wherein a one end portion of the plate-like elastic portion is in contact with the developer bearing member, and the other end portion of the plate-like elastic portion is supported by the developer container in a direction orthogonal to a rotation axis direction of the developer bearing member, an elastic seal provided to be compressed between the developer bearing member and the developer container in an area of the developer container outside of the regulating blade in the rotation axis direction, configured to seal a gap between the developer bearing member and the developer container, and a pressing member configured to press the elastic seal so that an end surface of the elastic seal is brought into contact with an end surface of the plate-like elastic portion in the rotation axis direction, wherein the plate-like elastic portion includes a metal plate, a second projection projecting, in a direction approaching the developer bearing member, from a second surface of the metal plate that is provided on the one end portion side and faces the developer bearing member, and a first projection projecting, in a direction away from the developer bearing member, from a first surface opposite to the second surface of the metal plate on the one end portion side, and a projecting amount of the first projection from the metal plate is greater than a projecting amount of the second projection in a state in which the developer bearing member is not disposed, and wherein a top surface of the second projection is in contact with the surface of the developer bearing member, and an end surface of the first projection in the rotation axis direction is in contact with an end surface of the elastic seal in the rotation axis direction.

Further features of the present disclosure will become apparent from the following description of exemplary embodiments with reference to the attached drawings.

DESCRIPTION OF THE EMBODIMENTS

Figure 1:
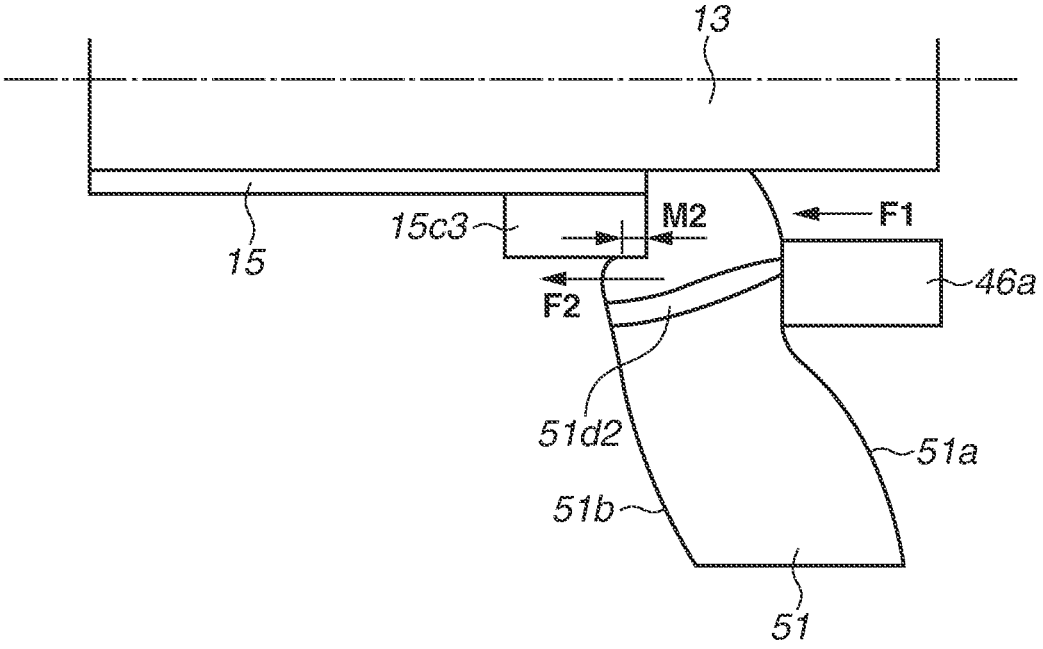
FIG. 1 is a cross-sectional view of a longitudinal end portion of a developing blade according to an exemplary embodiment.

A cartridge and an image forming apparatus according to the present disclosure are described with reference to the attached drawings. A laser beam printer main body, and a drum cartridge and a developing cartridge which are detachably attachable to the laser beam printer main body are respectively described as an example of an image forming apparatus and cartridges. In following descriptions, a longitudinal direction of the drum cartridge is a direction (a rotation axis direction) parallel to a rotation axis L1 of a photosensitive drum (an image bearing member), and a longitudinal direction of the developing cartridge is a direction (a rotation axis direction) parallel to a rotation axis L0 of a developing roller. The rotation axis L1 and the rotation axis L0 are in a direction intersecting with a conveyance direction of a recording medium. Further, a transverse direction of the drum cartridge is a direction substantially orthogonal to the rotation axis L1 of the photosensitive drum, and a transverse direction of the developing cartridge is a direction substantially orthogonal to the rotation axis L0 of the developing roller. According to the present exemplary embodiment, a direction for attaching and detaching the drum cartridge and the developing cartridge to and from the laser beam printer main body is the transverse direction of each cartridge. Reference numerals in the descriptions are used for referring to the drawings and do not restrict the configuration.

(1) Entire Description of Apparatus Main Body

Figure 2:
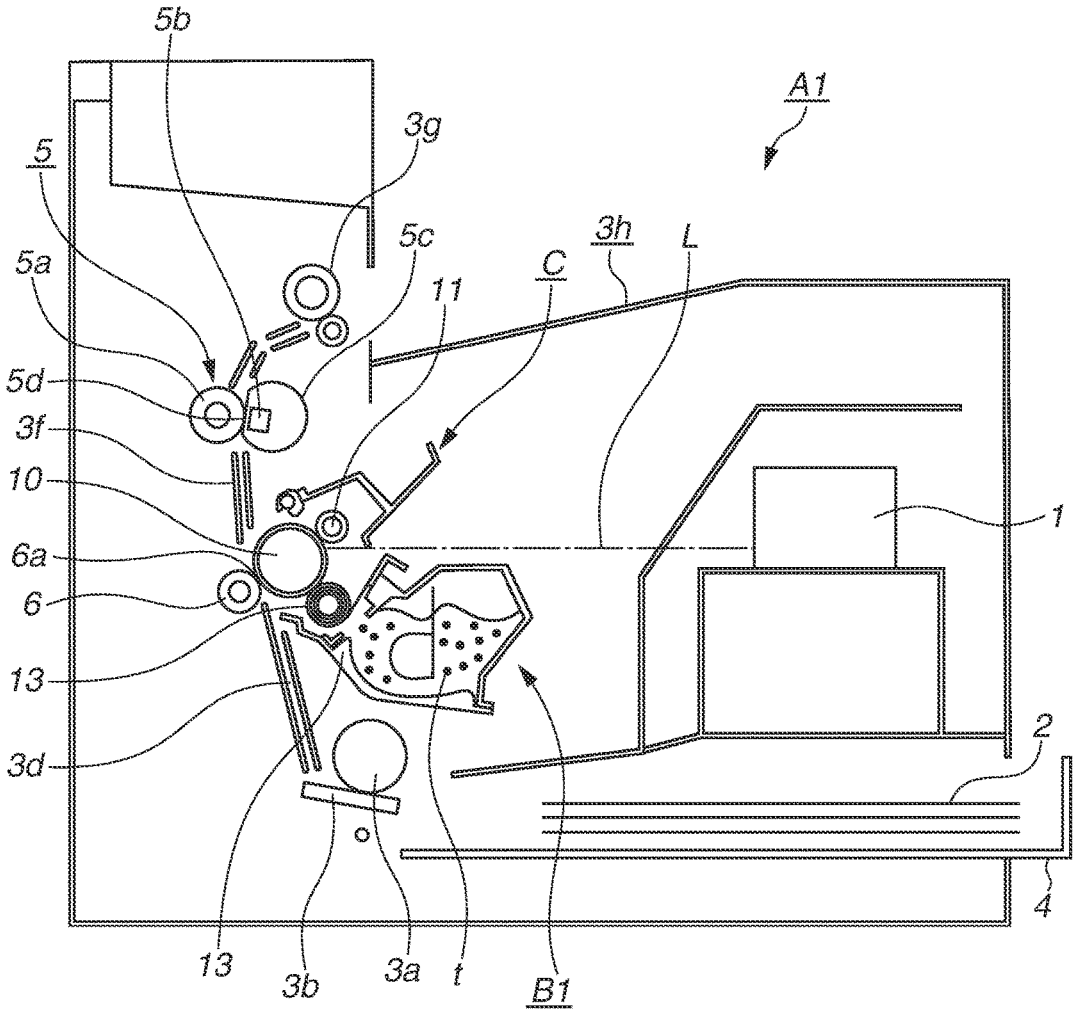
FIG. 2 is a cross-sectional view of an image forming apparatus main body and a process cartridge of an image forming apparatus according to the present exemplary embodiment.

An entire configuration of an apparatus main body is described with reference to FIG. 2. FIG. 2 is a cross-sectional view illustrating the apparatus main body. The apparatus main body illustrated in FIG. 2 forms an image using toner t on a recording medium 2 by an electrophotographic image forming process according to image information transmitted from an external device such as a personal computer. An example of the recording medium includes recording paper, label paper, an overhead projector (OHP) sheet, and a cloth. An apparatus main body A1 includes a photosensitive drum 10, an optical unit 1 for forming an electrostatic latent image on the photosensitive drum 10, a developing unit for forming a toner image by developing the electrostatic latent image, a transfer unit for transferring the toner image to the recording medium 2, and a fixing unit 5 for fixing the toner image to the recording medium 2. The photosensitive drum 10 is configured as a drum cartridge C so that a user can attach and detach the drum cartridge C to and from the apparatus main body A1, and similarly, the developing unit is configured as a developing cartridge B1 so that a user can attach and detach the developing cartridge B1 to and from the apparatus main body A1.

(2) Configuration of Developing Cartridge B1

Figure 3:
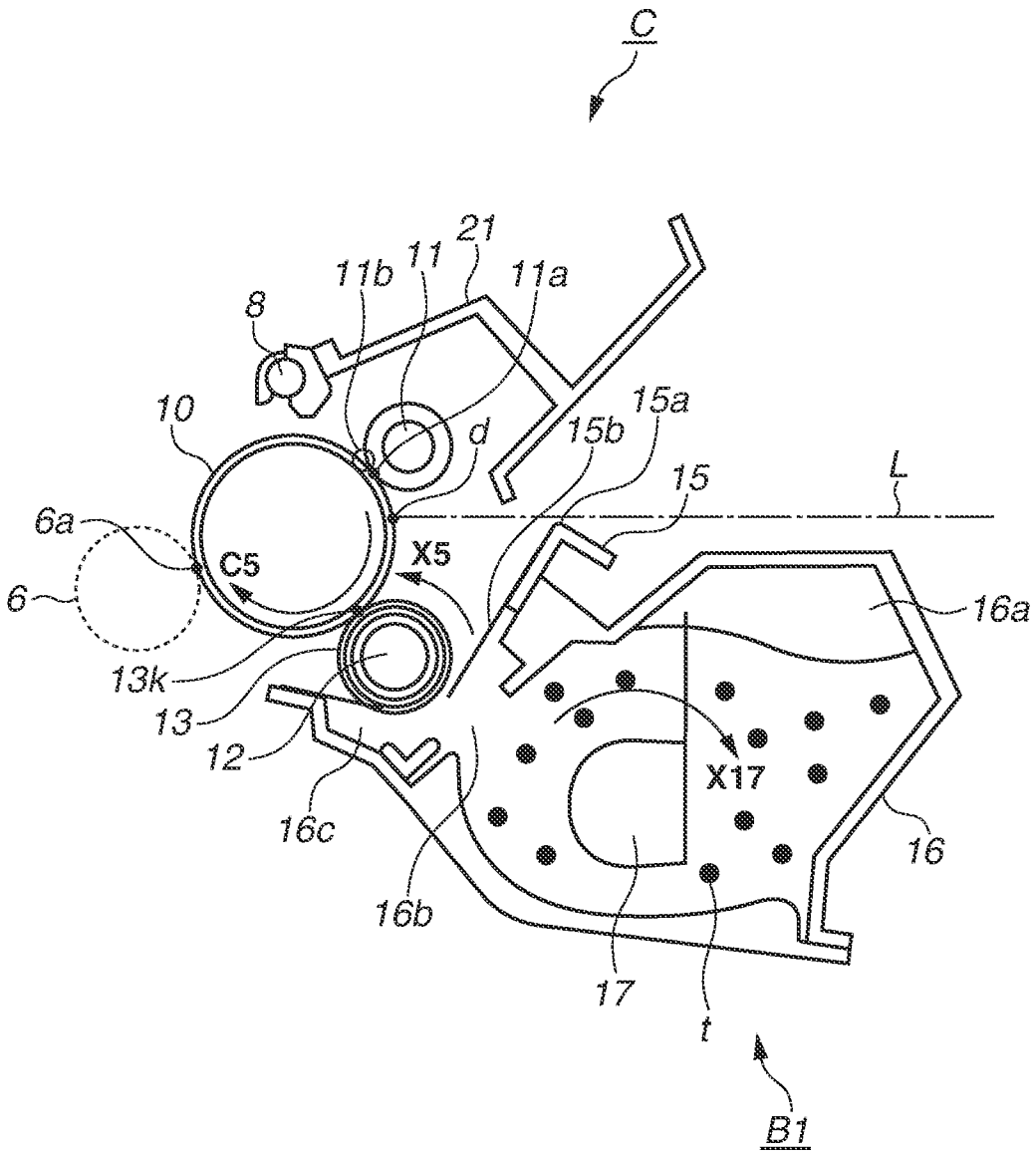
FIG. 3 is a cross-sectional view illustrating a configuration of a developing device unit according to the present exemplary embodiment.

Next, the electrophotographic image forming process is described with reference to FIG. 3. FIG. 3 is a cross-sectional view illustrating the developing cartridge B1 and the drum cartridge C. As illustrated in FIG. 3, the developing cartridge B1 includes a developer container 16 provided with a developing roller 13 as a developer bearing member and a developing blade 15.

The developer container 16 includes a toner containing unit 16*a* storing the toner t, a developing chamber 16*c* in which the developing roller (a developer bearing member) 13 and the developing blade (a regulating blade) 15 are arranged, and an opening portion 16*b* connecting the toner containing unit 16*a* and the developing chamber 16*c*. Thus, a toner conveyance member 17 rotatably provided to the toner containing unit 16*a* rotates in a direction of an arrow X17, so that the toner t stored in the toner containing unit 16*a* can be fed from the opening portion 16*b* to the developing chamber 16*c*. The developing chamber 16*c* is provided with the developing roller 13 constituted of a shaft portion incorporating a magnet roller 12 and a rubber portion which is rubber covering a circumferential surface of a center portion in the longitudinal direction of the shaft portion 13*e* (see FIG. 3). The shaft portion 13*e* is formed with an elongate cylinder made of a conductive member such as aluminum in which the center portion is covered with the rubber portion 13*d* in the longitudinal direction (see FIG. 3). The developing roller 13 can draw the toner t in the developing chamber 16*c* to a surface of the developing roller 13 by magnetic force of the magnet roller 12. The developing blade 15 is disposed in the developing chamber 16*c* so as to triboelectrically charge the toner t drawn to the surface of the developing roller 13 and regulate a layer thickness on the circumferential surface of the developing roller 13.

(3) Configuration of Drum Cartridge C

As illustrated in FIG. 3, the drum cartridge C includes a cleaning frame 21 provided with the photosensitive drum 10, a charging roller 11, and the like.

The drum cartridge C includes the photosensitive drum 10 rotatably supported and the charging roller 11 urged and brought into contact with the photosensitive drum 10 in the cleaning frame 21. The photosensitive drum 10 has a configuration in which a photosensitive member is disposed on a circumferential surface of a cylindrical body made of metal and the like, and can form an electrostatic latent image on a surface of the photosensitive member, namely the photosensitive drum 10. The charging roller 11 has a configuration in which an elastic member such as a foam is formed on a circumferential surface of a core metal and can uniformly charge the surface of the photosensitive drum 10 by a voltage applied from the apparatus main body A1. According to the present exemplary embodiment, the charging roller 11 is driven and rotated with respect to rotation of the photosensitive drum 10. More specifically, the surface of the photosensitive drum 10 is uniformly charged by the charging roller 11, and then an electrostatic latent image can be formed on the surface of the photosensitive drum 10 by a laser beam L from the optical unit 1 disposed in the apparatus main body A1.

(4) Description of Electrophotographic Image Forming Process

In the image forming apparatus, an image is formed on the recording medium 2 as described below.

First, the surface of the photosensitive drum 10 is uniformly charged by the charging roller 11 applied with a voltage from the apparatus main body A1. The charged photosensitive drum 10 is irradiated with the laser beam L corresponding to image information from the optical unit 1, and an electrostatic latent image corresponding to the image information is formed on the photosensitive drum 10. The developing roller 13 applied with the voltage from the apparatus main body A1 is rotated in a rotation direction X5 in a state in which the developing roller 13 is in contact with the photosensitive drum 10, thus the electrostatic latent image is developed by the toner t supplied to a development area of the photosensitive drum 10, and a toner image is formed on the surface of the photosensitive drum 10.

The developing roller 13 applied with the voltage from the apparatus main body A1 is rotated in the rotation direction X5 in the state in which the developing roller 13 is in contact with the photosensitive drum 10, so that the toner t is supplied to the development area of the photosensitive drum 10.

On the other hand, the recording medium 2 stored in a sheet feed tray 4 is regulated by a sheet feeding roller 3*a* and a separating pad 3*b* in pressure contact with the sheet feeding roller 3*a* and separated one by one in synchronization with formation of the toner image. A transfer roller 6 as the transfer unit is urged to contact the surface of the photosensitive drum 10 and forms a transfer nip portion 6*a* with the photosensitive drum 10. The recording medium 2 is conveyed by the conveyance guide 3*d* to the transfer nip portion 6*a* formed by the transfer roller 6 and the photosensitive drum 10 and passes through the transfer nip portion 6*a* . At that time, the transfer roller 6 is applied with a voltage having a polarity opposite to that of the toner image from the apparatus main body A1, and accordingly, the toner image formed on the surface of the photosensitive drum 10 is transferred to the recording medium 2.

The recording medium 2 on which the toner image is transferred is regulated by a conveyance guide 3*f* and conveyed to the fixing unit 5. The fixing unit 5 includes a driving roller 5*a* and a fixing roller 5*c* incorporating a heater 5*b*. The recording medium 2 is applied with heat and pressure when passing through a nip portion 5*d* formed by the driving roller 5*a* and the fixing roller 5*c*, and thus the toner image transferred to the recording medium 2 is fixed to the recording medium 2. Accordingly, an image is formed on the recording medium 2. Subsequently, the recording medium 2 is conveyed by a discharging roller pair 3*g* and discharged to a discharge portion 3*h*. Thus, the image formation on the recording medium 2 is completed.

(5) Toner Seal Configuration of Developing Cartridge

Figure 4A:
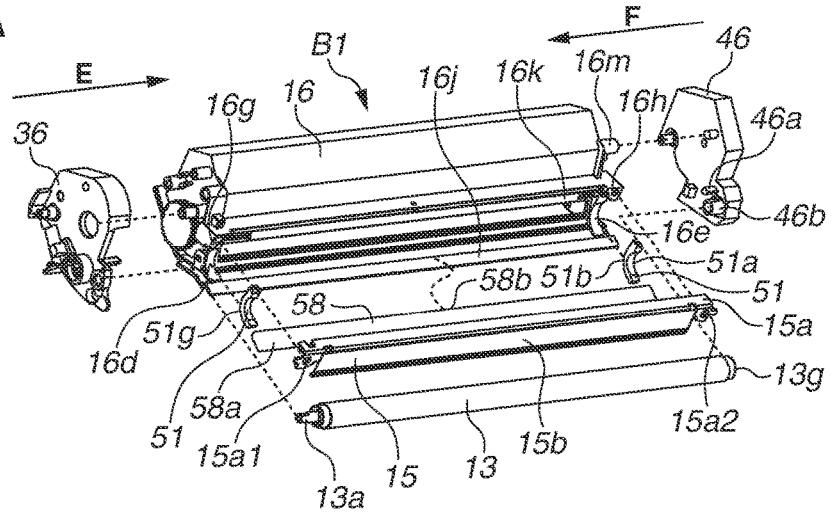
FIGS. 4A to 4C are perspective views illustrating a configuration of a developing cartridge according to the present exemplary embodiment.
Figure 4B:
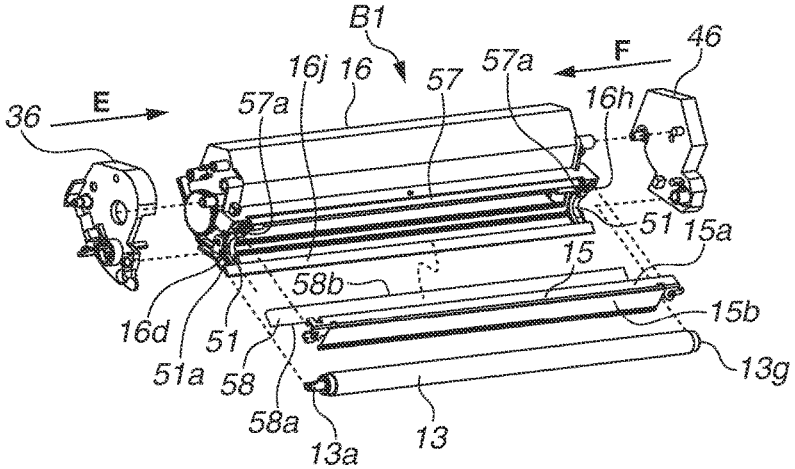
Figure 4C:
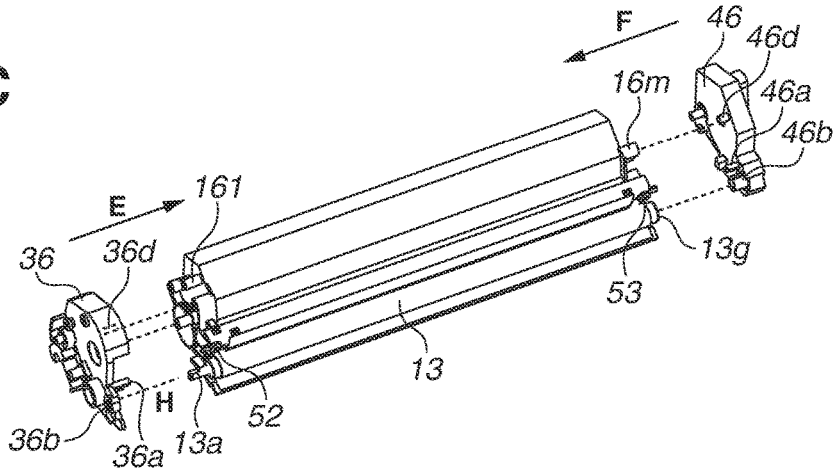
Figure 5A:
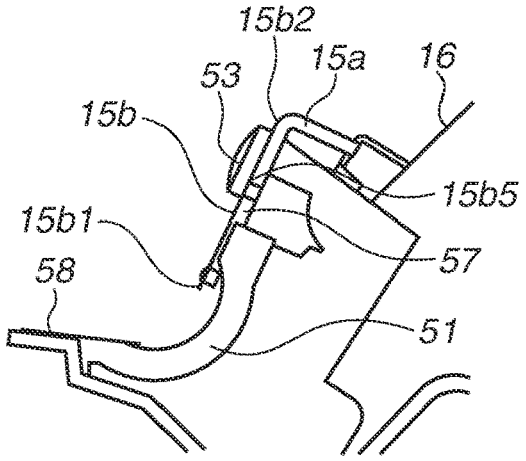
FIGS. 5A to 5C are cross-sectional views near the developing blade of the developing cartridge in a direction orthogonal to a longitudinal direction according to the present exemplary embodiment.
Figure 5B:
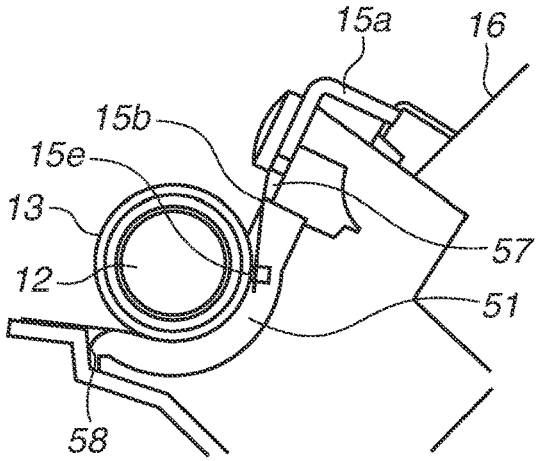
Figure 5C:
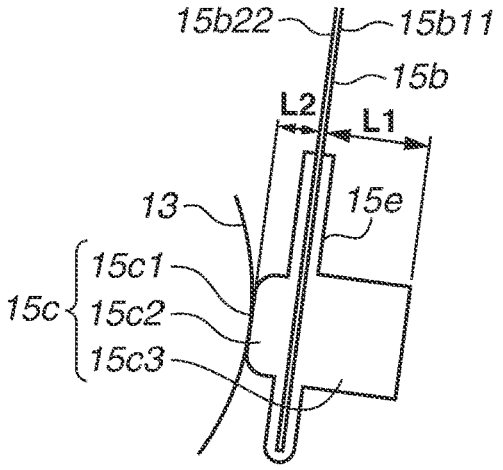

Next, an outline of a toner seal configuration of the developing cartridge B1 is described with reference to FIGS. 4A to 4C and FIGS. 5A to 5C. FIGS. 4A to 4C are exploded views illustrating the configuration of the developing cartridge B1. FIGS. 5A to 5C are cross-sectional views in a direction orthogonal to a rotation axis of the developing roller 13. FIG. 5A is the cross-sectional view when the developing blade 15 is assembled to the developer container 16, FIG. 5B is the cross-sectional view when the developing roller 13 is assembled to the developer container 16, and FIG. 5C is an enlarged view of an elastic resin member 15*c*.

As illustrated in FIGS. 4A to 4C, the developing cartridge B1 includes the developer container 16, the developing blade 15, a driving side development bearing 36, a non-driving side development bearing 46, the developing roller 13, a first sealing member 51, a second sealing member 57, and a third sealing member 58.

The driving side development bearing 36 includes a fitting portion 36*d*, a support portion 36*b*, and a seal pressing portion 36*a*, and the non-driving side development bearing 46 includes a fitting portion 46*d*, a support portion 46*b*, and a seal pressing portion 46*a*. The driving side development bearing 36 and the non-driving side development bearing 46 are assembled so as to sandwich the developer container 16 therebetween in such a manner that the fitting portion 46*d* engages with a second positioning hole 16*m* of the developer container 16, and the fitting portion 36*d* engages with a first positioning hole 161 of the developer container 16. Further, a non-driving side end portion 13*g* of the developing roller 13 and a driving side end portion 13*a* of the developing roller 13 are respectively rotatably supported by the support portion 46*b* and the support portion 36*b*.

The developing blade 15 is a plate member and fixed to the developer container 16 by screws 52 and 53. The developing blade 15 includes a conductive support member 15*a* made of sheet metal, an flexible elastic member 15*b* supported by the support member 15*a* on a fixing end portion 15*b*2 to have a cantilever structure, and the elastic resin member 15*c* disposed on a free end side of the elastic member 15*b*. More specifically, a driving side end portion 15*a*1 of the support member 15*a* is fixed to a third fixing surface 16*g* of the developer container 16 by the screw 52 on a driving side in the longitudinal direction, and a non-driving side end portion 15*a*2 of the support member 15*a* is fixed to a fourth fixing surface 16*h* of the developer container 16 by the screw 53 on a non-driving side in the longitudinal direction. According to the present exemplary embodiment, a metal plate (stainless steel (SUS) plate) is used as the elastic member 15*b* which is fixed to the support member 15*a* by welding a fixing end portion 15*b*2 by an yttrium aluminum garnet (YAG) laser. The elastic resin member 15*c* is configured to cover a first surface 15*b*11 and a second surface 15*b*22 of a free end portion 15*b*1 of the elastic member 15*b*. The elastic resin member 15*c* includes a top surface 15*c*1 being in contact with the developing roller 13, a second projection 15*c*2 including the top surface 15*c*1, and a first projection 15*c*3 projecting to a direction opposite to the second projection 15*c*2. The elastic resin member 15*c* has a base layer 15*e* on both of the first surface 15*b*11 and the second surface 15*b*22 of the elastic member 15*b*. The first projection 15*c*3 and the second projection 15*c*2 included in the elastic resin member 15*c* are projected more than the base layer 15*e*. In other words, when the elastic member 15*b* provided with the elastic resin member 15*c* is regarded as a plate-like elastic portion (15*b* and 15*c*), the developing blade 15 has a following configuration. The elastic resin member 15*c* which is a one end portion of the plate-like elastic portion (15*b* and 15*c*) is in contact with the developing roller 13, and another end portion thereof is supported by the support member 15*a* in a direction orthogonal to the rotation axis direction of the developing roller 13.

Further, the plate-like elastic portion (15*b* and 15*c*) includes the first projection 15*c*3 and the second projection 15*c*2. The second projection 15*c*2 projects from the second surface (15*b*22) of the elastic member 15*b* facing the developing roller 13 toward a direction approaching the developing roller 13. The first projection 15*c*3 projects from the first surface (15*b*11) on an opposite side of the second surface of the elastic member 15*b* toward a direction away from the developing roller 13. A projecting amount L1 of the first projection 15c3 from the elastic member 15b is greater than a projecting amount L2 of the second projection 15c2 in a state in which the developing roller 13 is not disposed. It is desirable that the projecting amount L1 of the first projection 15c3 is 500 μm or greater. It is desirable that the projecting amount L2 of the second projection 15c2 is 100 to 300 μm.

The second projection 15c2 projects so as to have a step portion that forms a gap between the developing roller 13 on an upstream side of a rotation direction of the developing roller 13 and the developing blade 15. The second projection 15c2 abuts on the developing roller 13, thus a peak value of an abutting pressure between the developing blade 15 and the developing roller 13 is increased, and the toner is convected on an upstream side of the second projection 15c2 so as to improve image quality. Specifically, the developing roller 13 abuts on a top surface 15c1 of the developing blade 15 while bending the elastic member 15b as illustrated in FIGS. 5A to 5C. It is configured that a predetermined contact pressure acts on a contact region between the top surface 15c1 of the elastic member 15b and the developing roller 13 when the elastic member 15b is bent.

Figure 6:
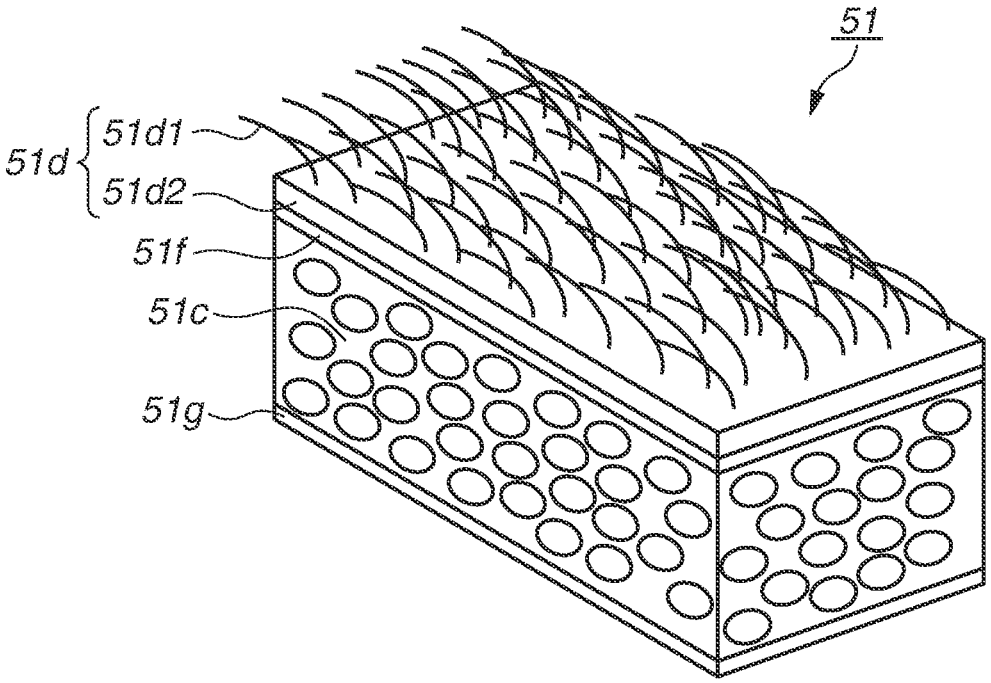
FIG. 6 is a perspective view illustrating a configuration of a first sealing member according to the present exemplary embodiment.

In addition, in the developer container 16, the developing roller 13 is provided with the first sealing members 51 as elastic sealing members on the respective end portions on a driving side and a non-driving side to suppress outside leakage of the toner, and the first sealing members 51 seal between the developing roller 13 and the developer container 16 (FIG. 4A). The first sealing member 51 is disposed to be compressed between the developing roller 13 and the developer container 16 and seals a gap therebetween in an area outside of the developing blade 15 of the developer container 16 with respect to the rotation axis direction of the developing roller 13. As illustrated in FIG. 6, the first sealing member 51 is constituted of a plurality of layers, more specifically, a surface layer 51d, an intermediate layer 51c, an adhesive layer 51f adhering the surface layer 51d and the intermediate layer 51c, and a pasting layer 51g fixing the intermediate layer 51c to the developer container 16. The surface layer 51d includes a base fabric 51d2 and pile yarns 51d1 rising from the base fabric 51d2. The pile yarn 51d1 may include a synthetic fiber such as polyethylene, polypropylene, polyester, nylon, acrylic resin, and polyethylene terephthalate, a half-synthetic fiber cotton such as rayon, a natural fiber such as cotton, combinations of these fibers, and twisted yarns. The base fabric 51d2 includes polyester and the like as a material thereof and is formed as a knit fabric and a woven fabric. The base fabric 51d2 is impregnated with a resin adhesive to fix the pile yarn 51d1 so as not to fall out from the base fabric 51d2. The intermediate layer 51c is a cushion layer formed by an elastic member and synthetic resin foam made from polyurethane and the like. The first sealing member 51 is compressed and disposed between the developing roller 13 and the developer container 16 in such a manner that the pasting layer 51g is pasted on a first fixing surface 16d and a second fixing surface 16e of the developer container 16. Accordingly, the developer container 16 is configured to prevent the toner from leaking from both ends in the longitudinal direction of the developing roller 13.

In addition, the developer container 16 is provided with the second sealing member 57 made from an elastomer resin and the third sealing member 58 made from a flexible sheet. The second sealing member 57 is formed by injection molding with respect to the developer container to contact the respective first sealing members 51 between the first sealing members 51 arranged on the both ends in the longitudinal direction. The second sealing member 57 seals between the developer container 16 and the support member 15a and can prevent leakage of the toner when the developing blade 15 is attached to the developer container 16. On the other hand, the third sealing member 58 is disposed along the axis direction of the developing roller 13 in such a manner that a one end side 58a in a transverse direction is fixed to a fifth fixing surface 16j of the developer container 16 by a joining unit such as a two-sided adhesive tape. Further, another end side of the third sealing member 58 in the transverse direction projects from the fifth fixing surface 16j to be in contact with the assembled developing roller 13 and thus seals a gap extending in the longitudinal direction formed between the developer container 16 and the developing roller 13. In a state in which the developing roller 13 is assembled, the third sealing member 58 is urged by the developing roller 13 and pressed to the first sealing member 51. Accordingly, the first sealing member 51 and the third sealing member 58 are in contact tightly with each other without a gap to prevent the toner from leaking from a gap between the developer container 16 and the developing roller 13.

(6) Seal Configuration of Longitudinal End Portion of Developing Blade

Figure 7A:
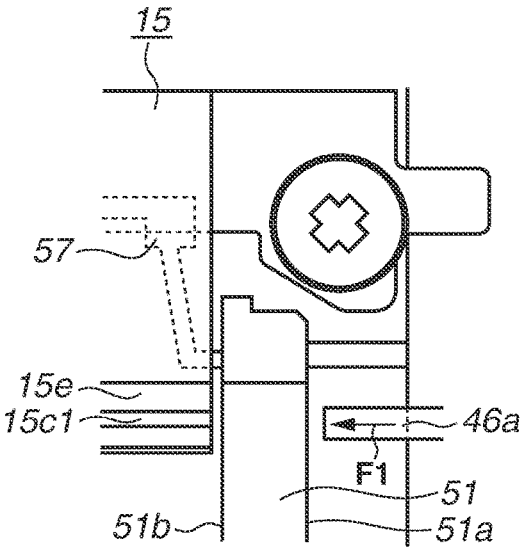
FIGS. 7A and 7B are top views illustrating a configuration of a longitudinal end portion of the developing device according to the present exemplary embodiment.
Figure 7B:
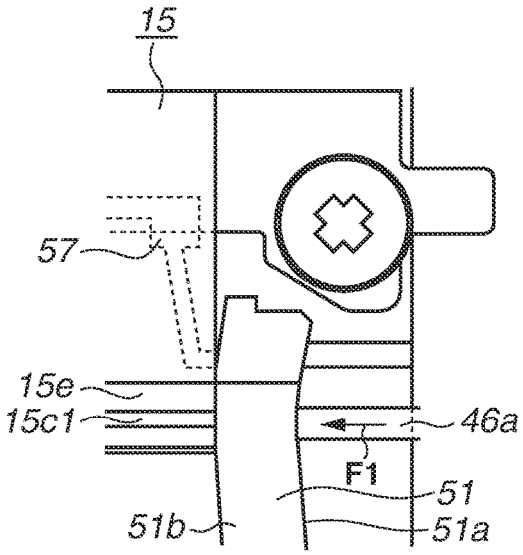

A detail configuration of a seal of a longitudinal end portion of the developing blade 15 in the developing cartridge B1 is described with reference to FIG. 1 and FIGS. 7A and 7B. A non-driving side is described as an example, however, a driving side has the same configuration. The non-driving side development bearing 46 corresponds to the driving side development bearing 36, and the seal pressing portion 46a corresponds to the seal pressing portion 36a. FIG. 1 illustrates a periphery and a cross section of the first sealing member 51. FIGS. 7A and 7B are enlarged top views of a one end portion of the developing blade 15 in the longitudinal direction which illustrates before and after assembly of the non-driving side development bearing 46. FIG. 7A is the top view illustrating a state before the non-driving side development bearing 46 is assembled, and FIG. 7B is the top view illustrating a state after the non-driving side development bearing 46 is assembled.

As illustrates in FIG. 7A, in a state in which the developing blade 15 is attached to the developer container 16 provided with the first sealing member 51 and the second sealing member 57, a gap is formed between surfaces of the developing blade 15 and the first sealing member 51 facing each other. Thus, according to the present exemplary embodiment, the non-driving side development bearing 46 (a seal pressing member) is provided with the seal pressing portion 46a. The seal pressing portion 46a is configured to urge the first sealing member to the developing blade 15 when the non-driving side development bearing 46 is attached from the longitudinal end portion toward a center portion of the developer container 16 (an F direction in FIGS. 4A to 4C). In other words, the non-driving side development bearing 46 presses the first sealing member 51 so that an end surface (a side surface) of the first sealing member 51 is brought into contact with an end surface of the plate-like elastic portion (15b and 15c) in the rotation axis direction of the developing roller 13. Specifically, an outside end surface 51a of the first sealing member 51 is urged by the seal pressing portion 46a by force F1, and an inside end surface 51b opposed to the outside end surface 51a in the longitudinal direction is brought into contact with a longitudinal end surface of the developing blade 15. Thus, a gap is suppressed from being formed between the developing blade 15 and the first sealing member 51. Accordingly, when the developing blade 15 is brought into contact with a circumferential surface of the developing roller 13 to form a toner layer on the developing roller 13, the toner t which is scraped off by the second projection 15*c*2 of the developing blade 15 and moved in the longitudinal direction can be suppressed from leaking to the outside from the gap.

According to the present exemplary embodiment, an end surface shape of the developing blade 15 in the longitudinal direction is formed to have the first projection 15*c*3 projected from a surface opposed to a surface on which the second projection 15*c*2 including the top surface 15*c*1 is disposed as illustrated in FIG. 5C. In other words, when the seal pressing portion 46*a* presses the first sealing member 51, a width in a thickness direction of the developing blade 15 in contact with the first sealing member 51 becomes larger at an edge portion on a free end side of the developing blade 15. Thus, the first sealing member 51 can avoid crawling under the developing blade 15 without causing the inside end surface 51*b* of the first sealing member 51 to contact a side surface of the developing blade 15 facing outside in the longitudinal direction. Accordingly, the present exemplary embodiment can suppress an image defect caused by defective toner regulation which occurs in such a manner that the toner melts and adheres the top surface 15*c*1 by urging force from the developing blade 15 to the developing roller 13 by the first sealing member 51, and a gap is formed between the developing blade 15 and the developing roller 13.

Figure 8:
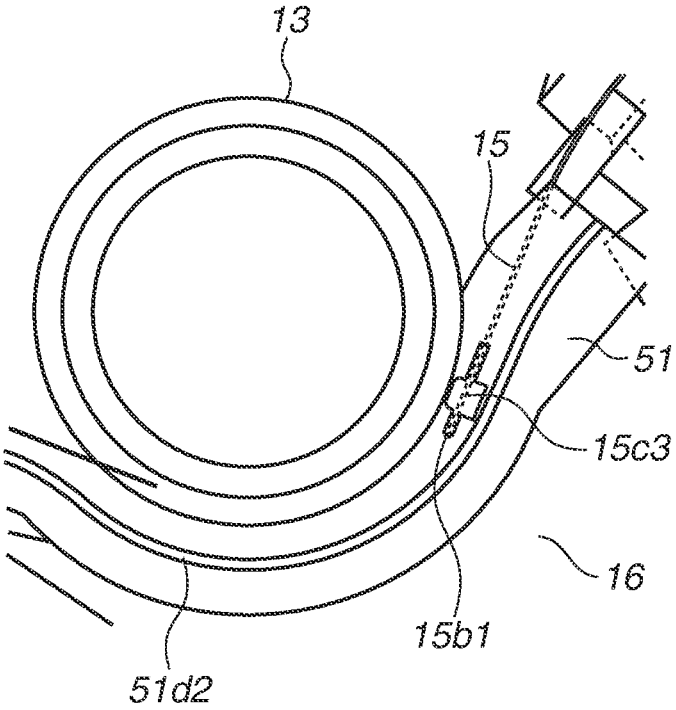
FIG. 8 is a cross-sectional view of the longitudinal end portion of the developing device in a direction orthogonal to the longitudinal direction according to the present exemplary embodiment.
Figure 9:
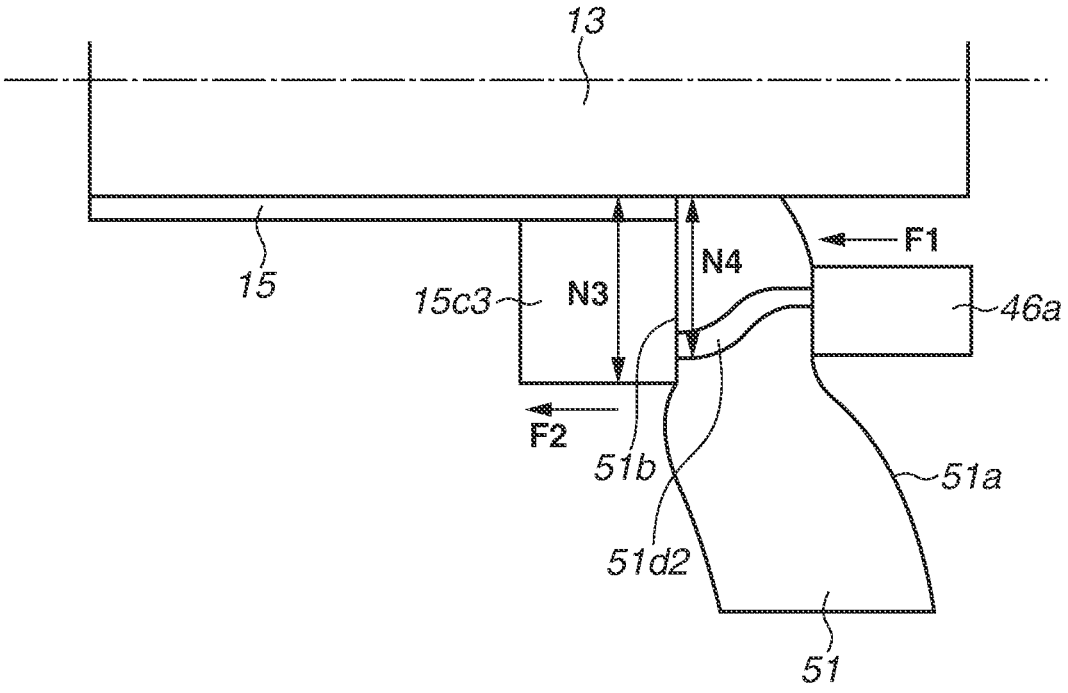
FIG. 9 is a cross-sectional view of a longitudinal end portion of a developing blade according to a modification of the present exemplary embodiment.

When a pressing surface 46*a*1 presses the outside end surface 51*a* of the first sealing member 51 in a direction of an arrow F, the surface layer 51*d* of the first sealing member 51 is moved in the direction of the arrow F, whereas the pasting layer 51*g* is fixed to the developer container 16 and does not move. In the first sealing member 51, the base fabric 51*d*2 has a configuration in which the knit fabric or the woven fabric is impregnated with the resin adhesive to prevent the pile yarn 51*d*1 from falling out from the base fabric 51*d*2, so that the base fabric 51*d*2 is the hardest compared to other layers and is hardly deformed. According to the present exemplary embodiment, the seal pressing portion 46*a* urges the outside end surface 51*a* including an end surface of the base fabric 51*d*2, while the inside end surface 51*b* not including the end surface of the base fabric 51*d*2 is brought into contact with the developing blade 15 (FIG. 8). Accordingly, the urging force of the developing blade 15 by the first sealing member 51 is regulated so as not to be excessive. On the other hand, when the urging force of the first sealing member 51 to the developing blade 15 is increased, a thickness N3 of the first projection 15*c*3 is thickened compared to a thickness N4 of the surface layer 51*d* to the base fabric 51*d*2 of the first sealing member 51 as illustrated in FIG. 9. Further, the seal pressing portion 46*a* urges the outside end surface 51*a* including the end surface of the base fabric 51*d*2, and the inside end surface 51*b* including the end surface of the base fabric 51*d*2 is brought into contact with the developing blade 15. Thus, it may be configured that a first contact portion 57*a*1 is urged by force F2 approximately equal to the force F1 urging the first sealing member 51 by the seal pressing portion 46*a* (F1≈F2). In addition, hardness of the surface layer 51*d* mat be appropriately adjusted to make the first projection 15*c*3 bite into the surface layer 51*d*, and thus seal performance may be improved. The present exemplary embodiment has a configuration for improving the seal performance in which the first sealing member 51 wraps around the first projection 15*c*3 for a distance M2 in the longitudinal direction to an extent not to increase force urging the developing blade 15 to the developing roller 13 by the first sealing member 51.

According to the present exemplary embodiment, the first projection 15*c*3 is arranged on a position to be symmetrical to the second projection 15*c*2 with respect to the elastic member 15*b*. Accordingly, a deformation for bending inside of the longitudinal direction which occurs when the first projection 15*c*3 is urged by the first sealing member 51 can be suppressed compared to when the first projection 15*c*3 is arranged on the free end side of the developing blade 15. Thus, the developing blade 15 can abut on the developing roller 13 more uniformly in the longitudinal direction. It is desirable that the first projection 15*c*3 overlaps with the second projection 15*c*2 in a direction orthogonal to the rotation axis direction when viewed from the rotation axis direction of the developing roller 13. It is desirable that the first projection 15*c*3 is disposed in an area excluding an edge of the free end portion 15*b*1 of the elastic member 15*b*. In addition, the present exemplary embodiment can suppress the first sealing member 51 from crawling under the developing blade 15 more satisfactorily compared to when the first projection 15*c*3 is arranged on a fixing end side of the developing blade 15. Further, according to the present exemplary embodiment, a protrusion having a rectangular shape when viewing the first projection 15*c*3 from the outside in the longitudinal direction is provided only on the longitudinal end portion. However, the first projection 15*c*3 is not limited to the above-described configuration and may include a protrusion having a dome shape or a trapezoid shape viewed from the outside in the longitudinal direction. Further, a protrusion may be disposed along an entire area in the longitudinal direction of the elastic member 15*b* or may be formed by pasting a member in the longitudinal end portion of the blade. In addition, according to the present exemplary embodiment, the configuration is described in which protrusions to be the first projections 15*c*3 are provided on end surface shapes located on the both ends in the longitudinal direction of the developing blade 15. However, any configuration can be adopted as long as it can prevent the first sealing member 51 from crawling under the developing blade 15. Thus, it may be configured that an end surface of the first projection 15*c*3 is located inside than the elastic member 15*b* and an end surface of a portion covering the elastic member 15*b* of the elastic resin member 15*c* in the longitudinal direction in a range in which the end surface of the first projection 15*c*3 is in contact with the first sealing member 51.

Unless otherwise specifically described, the scope of the present disclosure is not limited only to functions, materials, shapes, relative arrangement, and the like of the components described in the present exemplary embodiment. In addition, the same effect can be obtained by replacing the above-described hardness with Young's modulus and buckling strength.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-142025, filed Jul. 21, 2017, which is hereby incorporated by reference herein in its entirety.

What is claimed is:

1. A developing device comprising:

a developer bearing member configured to bear developer on a surface thereof;

a developer container configured to contain the developer, that is to be supplied to the developer bearing member;

a regulating blade including an elastic portion, configured to regulate a thickness of a layer of the developer borne on the surface of the developer bearing member, wherein one end portion of the elastic portion, in an orthogonal direction orthogonal to a rotation axis direction of the developer bearing member, is in contact with the developer bearing member, and the other end portion of the elastic portion in the orthogonal direction is supported by the developer container;

an elastic seal provided so as to be compressed between the developer bearing member and the developer container in an area of the developer container outside of the regulating blade in the rotation axis direction, configured to seal a gap between the developer bearing member and the developer container; and a pressing member configured to press the elastic seal so that an end surface of the elastic seal in the rotation axis direction is in contact with an end surface of the elastic portion in the rotation axis direction, wherein the elastic portion includes a metal plate, and first and second projections provided on the metal plate, the second projection projecting, in a direction approaching the developer bearing member, from a second surface of the metal plate that faces the developer bearing member, the first projection projecting, in a direction away from the developer bearing member, from a first surface opposite to the second surface of the metal plate, the first projection overlapping with the second projection when viewed in a direction in which the second projection projects, a projecting amount of the first projection from the first surface of the metal plate being greater than a projecting amount of the second projection from the second surface of the metal plate in a state in which the developer bearing member is not disposed, and wherein a tip of the second projection is in contact with the surface of the developer bearing member, and an end surface of the first projection in the rotation axis direction is in contact with an end surface of the elastic seal in the rotation axis direction.

2. The developing device according to claim 1, wherein the first projection overlaps with the second projection in the orthogonal direction when viewed in the rotation axis direction.

3. The developing device according to claim 1, wherein the first projection is disposed in an entire area of the elastic portion in the rotation axis direction.

4. The developing device according to claim 1, wherein the first projection and the second projection are formed of a resin layer covering the metal plate.

5. The developing device according to claim 1, wherein the elastic seal includes a pile yarn and a base fabric on which the pile yarn is fixed, and wherein the side surface of the first projection is in contact with an end surface of the base fabric of the elastic seal in the rotation axis direction.

6. A developing device comprising:

a developer bearing member configured to bear developer on a surface thereof;

a developer container configured to contain the developer, that is to be supplied to the developer bearing member;

a regulating blade including an elastic portion, configured to regulate a thickness of a layer of the developer borne on the surface of the developer bearing member, wherein one end portion of the elastic portion, in an orthogonal direction orthogonal to a rotation axis direction of the developer bearing member, is in contact with the developer bearing member, and the other end portion of the elastic portion in the orthogonal direction is supported by the developer container in a orthogonal direction orthogonal to a rotation axis direction of the developer bearing member;

an elastic seal provided so as to be compressed between the developer bearing member and the developer container in an area of the developer container outside of the regulating blade in the rotation axis direction, configured to seal a gap between the developer bearing member and the developer container; and a pressing member configured to press the elastic seal so that an end surface of the elastic seal in the rotation axis direction is in contact with an end surface of the elastic portion in the rotation axis direction, wherein the elastic portion includes a metal plate, and a resin layer covering a facing surface of the metal plate facing the developer bearing member and an opposite surface of the metal plate opposite to the facing surface, a part of the resin layer covering the opposite surface of the metal plate includes a base portion and a projecting portion arranged adjacent to the base portion in the orthogonal direction and having a thickness greater than that of the base portion so that the projecting portion projects further, in a direction away from the developer bearing member, than the base portion, and wherein an end surface of the projecting portion in the rotation axis direction is in contact with an end surface of the elastic seal in the rotation axis direction.

7. The developing device according to claim 6, wherein the projection is disposed in an area excluding an edge on the one end portion side of the metal plate.

8. The developing device according to claim 6, wherein the projection is disposed in an entire area of the elastic portion in the rotation axis direction.

9. The developing device according to claim 6, wherein the elastic seal includes a pile yarn and a base fabric on which the pile yarn is fixed, and wherein the end surface of the projection in the rotation axis direction is in contact with an end surface of the base fabric of the elastic seal in the rotation axis direction.

10. A developing device comprising:

a developer bearing member configured to bear developer on a surface thereof;

a developer container configured to contain the developer, that is to be supplied to the developer bearing member;

a regulating blade including an elastic portion, configured to regulate a thickness of a layer of the developer borne on the surface of the developer bearing member, wherein one end portion of the elastic portion, in an orthogonal direction orthogonal to a rotation axis direction of the developer bearing member, is in contact with the developer bearing member, and the other end portion of the elastic portion in the orthogonal direction is supported by the developer container;

an elastic seal provided so as to be compressed between the developer bearing member and the developer container in an area of the developer container outside of the regulating blade in the rotation axis direction, configured to seal a gap between the developer bearing member and the developer container; and a pressing member configured to press the elastic seal so that an end surface of the elastic seal in the rotation axis direction is in contact with an end surface of the elastic portion in the rotation axis direction, wherein the elastic portion includes a metal plate, and first and second projections provided on the metal plate, the second projection projecting, in a direction approaching the developer bearing member, from a second surface of the metal plate that faces the developer bearing member, the first projection projecting, in a direction away from the developer bearing member, from a first surface opposite to the second surface of the metal plate, a projecting amount of the first projection from the first surface of the metal plate being greater than a projecting amount of the second projection from the second surface of the metal plate in a state in which the developer bearing member is not disposed, wherein the elastic portion does not include, on the second surface of the metal plate, any projection projecting further than the second projection in the direction approaching the developer bearing member, and wherein a tip of the second projection is in contact with the surface of the developer bearing member, and an end surface of the first projection in the rotation axis direction is in contact with an end surface of the elastic seal in the rotation axis direction.

11. The developing device according to claim 10, wherein the first projection overlaps with the second projection in the orthogonal direction when viewed in the rotation axis direction.

12. The developing device according to claim 10, wherein the first projection is disposed in an area excluding an edge on the one end portion side of the metal plate.

13. The developing device according to claim 10, wherein the first projection is disposed in an entire area of the elastic portion in the rotation axis direction.

14. The developing device according to claim 10, wherein the first projection and the second projection are formed of a resin layer covering the metal plate.

15. The developing device according to claim 10, wherein the elastic seal includes a pile yarn and a base fabric on which the pile yarn is fixed, and wherein the side surface of the first projection is in contact with an end surface of the base fabric of the elastic seal in the rotation axis direction.

* * * * *